US008122964B2

(12) United States Patent
Judge et al.

(10) Patent No.: US 8,122,964 B2
(45) Date of Patent: Feb. 28, 2012

(54) SUBSEA STACK ALIGNMENT METHOD

(75) Inventors: Robert Arnold Judge, Houston, TX (US); Perrin S. Rodriguez, Cypress, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 492 days.

(21) Appl. No.: 12/129,366

(22) Filed: May 29, 2008

(65) Prior Publication Data

US 2009/0294129 A1 Dec. 3, 2009

(51) Int. Cl.
*E21B 33/038* (2006.01)

(52) U.S. Cl. ..... 166/341; 166/338; 166/344; 166/85.1; 166/85.4

(58) Field of Classification Search ..... 166/341, 166/338, 339, 344, 381, 383, 85.1, 85.4, 166/85.5
See application file for complete search history.

(56) References Cited

U.S. PATENT DOCUMENTS 3,551,005 A * 12/1970 Brun ..... 285/10

(Continued)

OTHER PUBLICATIONS

Radoil, Inc., "Vertical Hot Stab Assembly Drawings," Nov. 13, 2007, pp. 1-4.

*Primary Examiner* — Thomas Beach
*Assistant Examiner* — Matthew Buck
(74) *Attorney, Agent, or Firm* — Potomac Patent Group PLLC

(57) ABSTRACT

A method to interchangeably connect a plurality of Lower Marine Riser Packages with a lower BOP stack includes engaging a Lower Marine Riser Package connector of the Lower Marine Riser Package, with a Lower Stack mandrel connector of a Lower Stack, thereby aligning the Lower Marine Riser Package and the Lower Stack axially about a vertical axis, engaging at least one ring alignment pin of the Lower Marine Riser Package with at least one alignment plate of the Lower Stack, thereby rotationally aligning the Lower Marine Riser Package and the Lower Stack within a specified angle about the vertical axis, and engaging feed-thru connections between the Lower Marine Riser Package and the Lower Stack.

18 Claims, 9 Drawing Sheets

U.S. PATENT DOCUMENTS

| | | | | |
|---|---|---|---|---|
| 4,167,215 | A * | 9/1979 | Thorne | 166/341 |
| 4,171,922 | A * | 10/1979 | Coulboy et al. | 405/169 |
| 4,635,728 | A * | 1/1987 | Harrington | 166/341 |
| 4,878,783 | A * | 11/1989 | Baugh | 405/169 |
| 5,794,701 | A * | 8/1998 | Cunningham et al. | 166/341 |
| 5,971,077 | A * | 10/1999 | Lilley | 166/368 |
| 6,089,321 | A * | 7/2000 | Morrill | 166/341 |
| 6,106,026 | A * | 8/2000 | Smith, III | 285/85 |
| 6,142,233 | A * | 11/2000 | Wilkins | 166/339 |
| 6,227,300 | B1 * | 5/2001 | Cunningham et al. | 166/339 |
| 6,644,410 | B1 * | 11/2003 | Lindsey-Curran et al. | 166/360 |
| 6,679,472 | B2 * | 1/2004 | Baugh | 251/62 |
| 6,805,382 | B2 * | 10/2004 | Jennings | 285/18 |
| 6,827,147 | B2 * | 12/2004 | Dallas | 166/379 |
| 6,938,695 | B2 * | 9/2005 | Williams | 166/341 |
| 7,172,447 | B2 * | 2/2007 | Allensworth et al. | 439/271 |
| 7,216,714 | B2 * | 5/2007 | Reynolds | 166/338 |
| 7,216,715 | B2 * | 5/2007 | Reynolds | 166/339 |
| 7,222,674 | B2 * | 5/2007 | Reynolds | 166/341 |
| 7,490,673 | B2 * | 2/2009 | Bartlett | 166/368 |
| 7,690,433 | B2 * | 4/2010 | Reynolds | 166/338 |
| 7,726,405 | B2 * | 6/2010 | McMiles | 166/344 |
| 2005/0072573 | A1 * | 4/2005 | Smith, III | 166/341 |
| 2009/0255681 | A1 * | 10/2009 | Spencer | 166/341 |
| 2009/0294130 | A1 | 12/2009 | Rodriguez | |
| 2010/0155074 | A1 | 6/2010 | Rodriguez | |

* cited by examiner

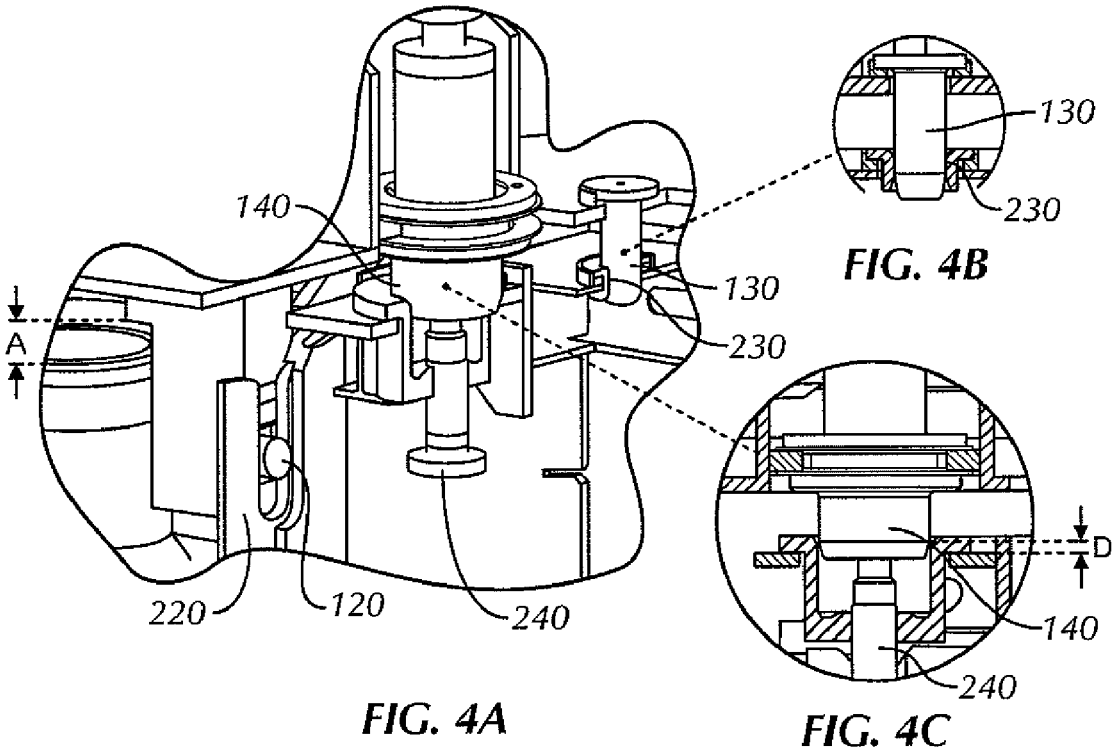
FIG. 4A
FIG. 4B
FIG. 4C
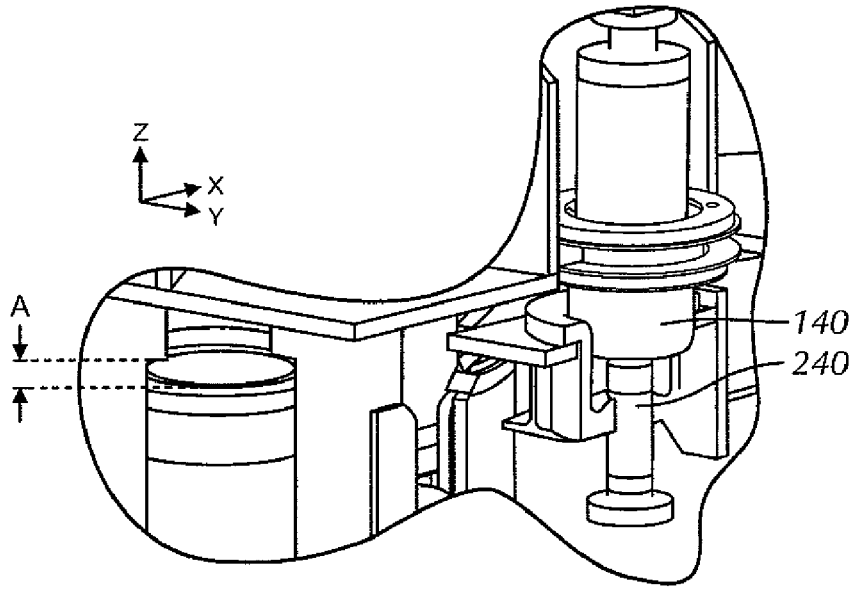
FIG. 5

SUBSEA STACK ALIGNMENT METHOD

BACKGROUND

1. Field of the Disclosure

Embodiments disclosed herein relate generally to joining subsea stack assemblies. In particular, embodiments disclosed herein relate to methods to design and assemble interchangeable subsea stack assemblies.

2. Background Art

Well control is an important aspect of oil and gas exploration. When drilling a well in, for example, oil and gas exploration applications, devices must be put in place to prevent injury to personnel and equipment associated with the drilling activities. One such well control device is known as a blowout preventer (BOP).

Blowout preventers are generally used to seal a wellbore. For example, drilling wells in oil or gas exploration involves penetrating a variety of subsurface geologic structures, or "layers." Each layer generally comprises a specific geologic composition such as, for example, shale, sandstone, limestone, etc. Each layer may contain trapped fluids or gas at different formation pressures, and the formation pressures increase with increasing depth. The pressure in the wellbore is generally adjusted to at least balance the formation pressure by, for example, increasing a density of drilling mud in the wellbore or increasing pump pressure at the surface of the well.

There are occasions during drilling operations when a wellbore may penetrate a layer having a formation pressure substantially higher than the pressure maintained in the wellbore. When this occurs, the well is said to have "taken a kick." The pressure increase associated with the kick is generally produced by an influx of formation fluids (which may be a liquid, a gas, or a combination thereof) into the wellbore. The relatively high pressure kick tends to propagate from a point of entry in the wellbore uphole (from a high pressure region to a low pressure region). If the kick is allowed to reach the surface, drilling fluid, well tools, and other drilling structures may be blown out of the wellbore. These "blowouts" often result in catastrophic destruction of the drilling equipment (including, for example, the drilling rig) and in substantial injury or death of rig personnel.

Because of the risk of blowouts, blowout preventers are typically installed at the surface or on the sea floor in deep water drilling arrangements so that kicks may be adequately controlled and "circulated out" of the system. Blowout preventers may be activated to effectively seal in a wellbore until active measures can be taken to control the kick. There are several types of blowout preventers, the most common of which are annular blowout preventers and ram-type blowout preventers.

Annular blowout preventers typically comprise annular elastomer "packers" that may be activated (e.g., inflated) to encapsulate drill pipe and well tools and completely seal the wellbore. A second type of the blowout preventer is the ram-type blowout preventer. Ram-type preventers typically comprise a body and at least two oppositely disposed bonnets. The bonnets are generally secured to the body about their circumference with, for example, bolts. Alternatively, bonnets may be secured to the body with a binge and bolts so that the bonnet may be rotated to the side for maintenance access.

Interior of each bonnet contains a piston actuated ram. The functionality of the rams may include pipe rams, shear rams, or blind rams. Pipe rams (including variable bore rams) engage and seal around the drill pipe or well tool left in the wellbore, leaving the engaged objects intact. In contrast, shear rams engage and physically shear the drill pipe or well tools left in the wellbore. Similarly, blind rams engage each other and seal off the wellbore when no drill pipe or well tools are in the wellbore. The rams are typically located opposite of each other and, whether pipe rams, shear rams, or blind rams, the rams typically seal against one another proximate a center of the wellbore in order to seal the wellbore.

As such, many oil and gas bearing formations lie beneath large bodies of water. Producing wells extending into these formations are equipped with subsea wellheads and other underwater installations which rest at the ocean or sea floor. As such, it is customary to provide blowout protection and other related functions during subsea drilling operations. As such subsea blowout preventer installations may be equipped with numerous and varied types of valves, rams, and other operating controls that may be hydraulically, electro-mechanically, or electro-hydraulically operated to control wellbore fluids.

In shallow water, many subsea blowout preventer and flow control installations are controlled hydraulically. These all-hydraulic systems may include a bundle of hydraulic hoses and control lines extending between the surface and subsea facilities. Alternatively, individual hoses may supply hydraulic power from the surface to the subsea installation to monitor the status of the subsea equipment and perform control operations. Advantageously, these systems are simple, reliable, and inexpensive for relatively short hose lengths (i.e., water depths) although response time may be slow. However, in deep-water installations, the response time for a hydraulic system increases and its reliability decreases.

In response to the demands of deep-water subsea environments, electro-hydraulic systems were introduced to improve the performance of traditional hydraulic systems in deep water or over long distances. As such, an electro-hydraulic subsea control cable may employ a multiplex (MUX) hose in which several hydraulic control signals may be multiplexed (e.g., through digital time division) and transmitted. The multitude of signals may then be separated out at the end of the multiplex hose and used to manipulate valves in a control pod of a blowout preventer or another subsea component. While a multiplex umbilical line may be a hydraulic hose, it should be understood that an electrical line may also serve as a multiplexing conduit.

Blowout preventer stacks are typically custom fit during an initial assembly process, which requires the stack assemblies to be test fit together at the surface prior to installation subsea. Further, the current method of manufacture may produce assemblies requiring a custom fit which are not interchangeable. For example, many feed-thrus or interconnects, such as the hydraulic feed-thrus and/or electro-hydraulic cables, between a Lower Marine Riser Package ("LMRP") and a Lower Stack, require adjustability upon assembly.

Accordingly, there exists a need for a stack assembly having complete interchangeability between an LMRP assembly and any Lower Stack assembly of the same design, without the need for any manual adjustments on the surface.

SUMMARY OF THE DISCLOSURE

In one aspect, embodiments disclosed herein relate to a method to interchangeably connect a plurality of Lower Marine Riser Packages with a lower BOP stack including engaging a Lower Marine Riser Package connector of the Lower Marine Riser Package, with a Lower Stack mandrel connector of a Lower Stack, thereby aligning the Lower Marine Riser Package and the Lower Stack axially about a vertical axis, engaging at least one ring alignment pin of the Lower Marine Riser Package with at least one alignment plate of the Lower Stack, thereby rotationally aligning the Lower Marine Riser Package and the Lower Stack within a specified angle about the vertical axis, and engaging feed-thru connections between the Lower Marine Riser Package and the Lower Stack.

In another aspect, embodiments disclosed herein relate to a method to design interchangeability between assemblies in a blowout preventer stack including providing over-sized mounting holes to receive critical components, establishing at least a first reference point on a first component, and calculating the locations of multiple feed-thru connections in the riser stack from the first reference point, allowing at least a first half of the feed-thru connections to float, self-aligning the first half of the feed-thru connection with a corresponding second half of the feed-thru connection of a second component, and establishing rotational and vertical alignments between the first and second components.

In another aspect, embodiments disclosed herein relate to an interchangeable blowout preventer stack including a Lower Marine Riser Package comprising a Lower Marine Riser Package female connector, a Lower Stack comprising a Lower Stack mandrel connector configured to engage and axially align with the Lower Marine Riser Package female connector, at least one ring alignment pin disposed on the Lower Marine Riser Package, at least one alignment plate disposed on the Lower Stack and configured to receive the at least one ring alignment pin, wherein the Lower Marine Riser Package and the Lower Stack are rotationally aligned within a specified angle, at least one final alignment pin disposed on the Lower Marine Riser Package, at least one final alignment pin receiver disposed on the Lower Stack and configured to receive the at least one final alignment pin, and a plurality of feed-thru connections between the Lower Marine Riser Package and the Lower Stack.

In another aspect, embodiments disclosed herein relate to a method to interchangeably connect a plurality of Lower Marine Riser Packages with a plurality of lower BOP stacks including using a reference template in constructing the lower BOP stacks and the Lower Marine Riser Packages such that they have aligning interfacing points.

Other aspects and advantages of the invention will be apparent from the following description and the appended claims.

BRIEF DESCRIPTION OF DRAWINGS

FIGS. 4A-4C are assembly views of a final alignment pin and a final alignment pin receiver in accordance with embodiments of the present disclosure.

FIG. 5 is an assembly view of a choke and kill connection in accordance with embodiments of the present disclosure.

DETAILED DESCRIPTION

In one aspect, embodiments disclosed herein relate to subsea stack assemblies. In particular, embodiments disclosed herein relate to methods to design and assemble interchangeable subsea stack assemblies.

Figure 1:
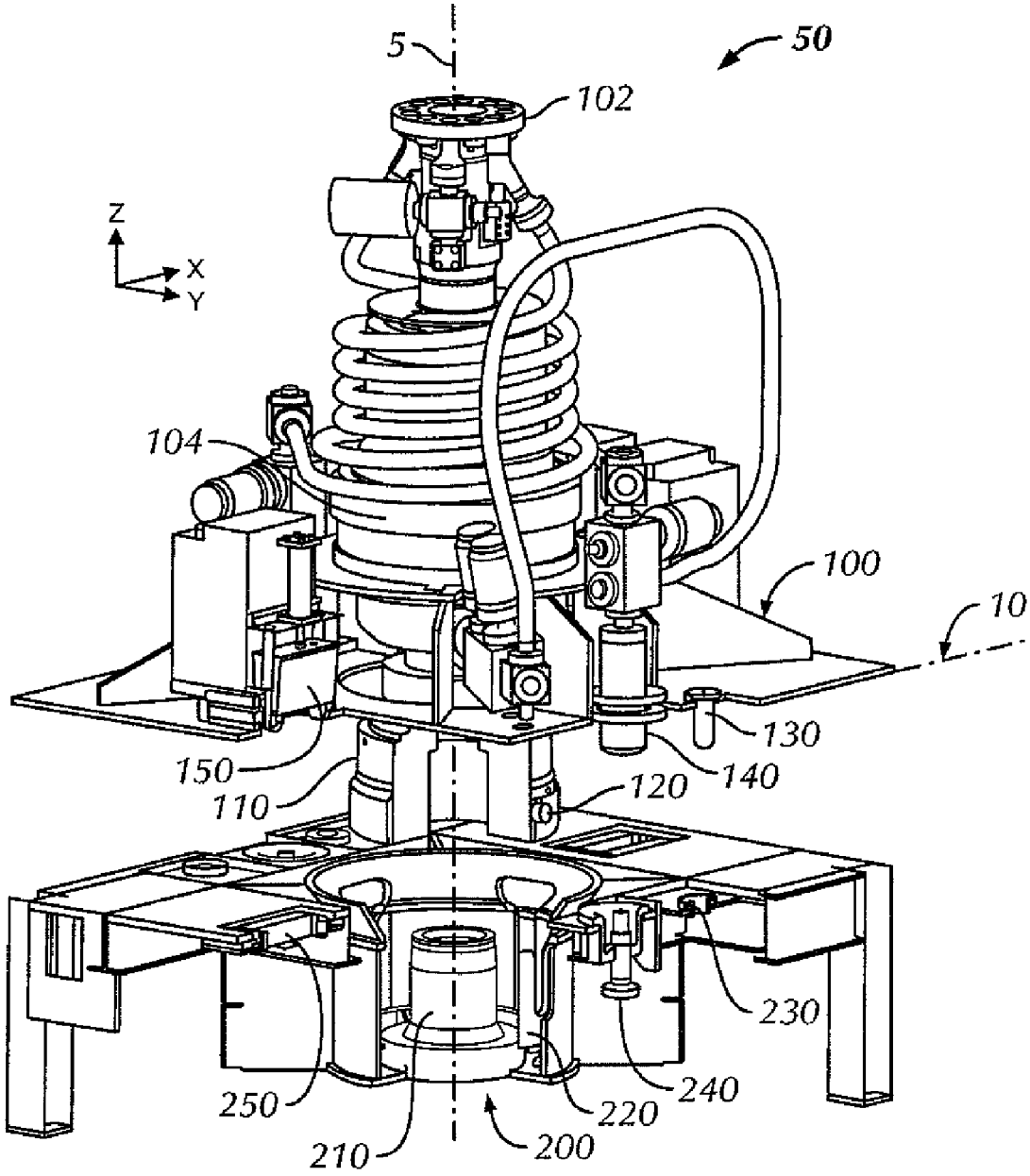
FIG. 1 is an assembly view of a Lower Marine Riser Package and a Lower Stack in accordance with embodiments of the present disclosure.

Referring to FIG. 1, a conventional subsea BOP stack 50 is shown in accordance with embodiments of the present disclosure. BOP stack 50 includes two main assemblies: a Lower Marine Riser Package ("LMRP") 100 and a Lower Stack 200. LMRP 100 may include a flexible riser joint 102 to which a riser (not shown) running up to a floating surface rig is attached, an annular blowout preventer 104 configured to seal an inner bore of LMRP 100, and multiple feed-thru connections. Lower Stack 200 may include a number of ram-type preventers (not shown) that are used to ensure pressure control of a well, as is well known in the art. The configuration of Lower Stack 200 may be optimized to provide maximum pressure integrity, safety, and flexibility in the event of a well control incident.

The ability to close in a well automatically plays an extremely important role in offshore drilling operations, both for safety and environmental reasons. BOP stack 50 first allows the rig to disengage quickly from the riser in the event that dynamic positioning is lost. The loss of the dynamic positioning of the rig may produce a condition in which the rig drifts off location with the riser, LMRP 100, and Lower Stack 200 still attached. Secondly, BOP stack 50 provides a means for protecting the integrity of the well during and after disconnect, as well as providing a means to protect the environment by preventing the release of drilling fluid or hydrocarbons into the ocean.

Designing Interchangeability Between the LMRP and the Lower Stack Assembly

BOP stack assemblies are typically custom fit during an initial assembly process before they are installed subsea. Feed-thrus from the Lower Marine Riser Package to the Lower Stack assembly are aligned and fixed so that each LMRP and Lower Stack assembly may unlatch and separate, and then re-mate after separation and continue operation from a drilling vessel. Feed-thrus may include, but are not limited to, choke and kill ("C/K") lines, hydraulic BOP operating fluid stabs, and MUX pod wedge block and receiver combinations. Conventional methods of manufacture render each stack assembly unique, and by definition, not interchangeable.

As defined herein, an interchangeable subsea stack design may allow the LMRP and Lower Stack to be assembled separately without having to first mate them together to make any necessary adjustments. For example, if a production set includes two stacks, "Stack 1" and "Stack 2," and both are comprised of two parts "LMRP1/LS1" and "LMRP2/LS2," respectively, then LMRP1 should also be able to mate with LS2, and LMRP2 should be able to mate with LS1 without any adjustment or intervention.

A significant obstacle that must be overcome to accomplish interchangeability is manufacturing the tolerances for the frame structures. All of the critical components (i.e., MUX pod system, choke and kill connections, hot stabs, and alignment system) that are installed on the frame must be aligned within a few thousandths of an inch for them to mate with their corresponding counterparts. Due to the size of the frames, features may only be fabricated within ¼ inch (i.e., ±⅛ inch) in certain embodiments, and standard milling machines may not be large enough to accept the frames.

Embodiments disclosed herein overcome this by using a combination of design techniques, which include the following. First, "over-sized" mounting holes on the frames which accept critical components during the assembly process may be used. Every critical component installed onto a stack frame fits into a corresponding opening or mounting hole. Typically, a majority of the stack frames received from various fabricators may have at least one feature or mounting hole that is out of position, which in turn may require added repair or rework of the equipment along with downtime. Standard manufacturing tolerances for a welded structure of this size may be as much as ±⅛ inch. Attempting to hold any tighter tolerance may only make the frames extremely costly and increase the number of repairs. Therefore, as defined herein, the over-sized mounting holes may be configured large enough to allow a certain margin of error when engaging connections. In certain embodiments, the over-sized mounting holes or openings may be over-sized by ½ inch radially or 1 inch diametrically. This provides the ability to position or locate fixed critical components accurately (e.g., within ±0.015 inches) on the frames, in the event that their corresponding mounting holes or openings are not manufactured exactly to print.

Next, in order for the fixed critical components to be positioned accurately (i.e., within ±0.015 inches), there should be two points of reference to locate them relative to: a vertical datum axis and a horizontal datum axis. Since the main connectors of a stack assembly, namely an LMRP connector and Lower Stack mandrel connector, are machined components having a known tolerance, their centerline may serve as the vertical datum axis. Further, front edges of the LMRP and Lower Stack frame may serve as the horizontal datum axis. The horizontal datum axis is used to locate the fixed components rotationally about the vertical axis, and ensures that when the LMRP and Lower Stack are mated together, their edges will be parallel to one another.

The next design technique involves a "floating" concept between corresponding components to aid in assembly. For the purpose of interchangeability, the term "float" may be defined as the ability of a component to move freely or float within a defined boundary, essentially allowing for some slight "play" between corresponding components. Three or more degrees of freedom may be incorporated into the critical components, such as a floating MUX pod receiver, and a floating choke and kill connector. As used herein, "floating" refers to both translational and rotational movements between mating components. Thus, both may be allowed to translate and rotate about a central axis by a an amount. In certain embodiments, both may allowed to translate off centerline in an XY plane (horizontal) and allowed to rotate approximately about the Z (vertical) axis. This will be described further in the description of the assembly process. One skilled in the art will understand that the amount that the components are allowed to float may vary without departing from the scope of the present embodiments.

Finally, another feature which makes interchangeability possible while keeping it cost effective is a precise measurement system. In embodiments disclosed herein, a laser measurement system may be used, as it is ideal for measuring large structures such as the ones used. However, one skilled in the art will understand alternative precise measurement systems available without departing from the scope of the present embodiments. The laser measurement system used with embodiments of the present disclosure may be capable of measuring a 200 foot circle within 0.005 inches, and a 20 foot circle within 0.001 inches. Additionally, the laser measurement system may be used to construct a "blue print" of each stack which may be followed during assembly. The blueprint may allow for a more accurate and reliable manufacturing process, as well as help with mass production of the assemblies.

Assembly of the LMRP and Lower Stack

Embodiments disclosed herein relate to a method to assemble an LMRP and a Lower Stack assembly subsea without requiring surface adjustments. The components include corresponding features which are "self-aligning," and which engage each other in a specified manner and sequence until the LMRP and Lower Stack are fully mated and functional.

Figure 2:
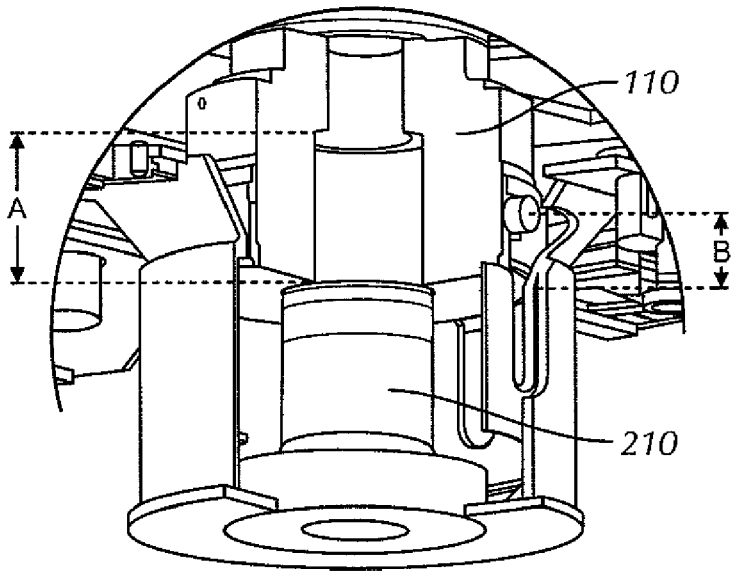
FIG. 2 is an assembly view of an LMRP connector and a mandrel connector in accordance with embodiments of the present disclosure.

Referring to FIGS. 1-6 and 9, a make-up sequence between a LMRP assembly 100 and a Lower Stack 200 is described in accordance with embodiments of the present disclosure. LMRP assembly 100 and Lower Stack 200 may be axially aligned about vertical datum axis 5 and may be longitudinally aligned with horizontal datum axis 10. Initially, a female LMRP connector 110 of LMRP assembly 100 makes contact with a corresponding mandrel male connector 210 of Lower Stack 200 as shown in FIG. 2. The engagement between LMRP connector 110 and mandrel connector 210 aligns LMRP 100 and Lower Stack 200 axially with each other.

As shown in FIG. 2, there may be a specified distance A of vertical travel remaining before LMRP connector 10 and mandrel connector 210 is fully engaged, as well as a specified distance B of vertical travel remaining before the next component is engaged. In certain embodiments, distance A may be between about 26 and 27 inches, while distance B may be between about 11.5 and 12.5 inches. Those skilled in the art will understand however, that distance A and distance B may vary without departing from the scope of embodiments of the present disclosure.

Figure 3:
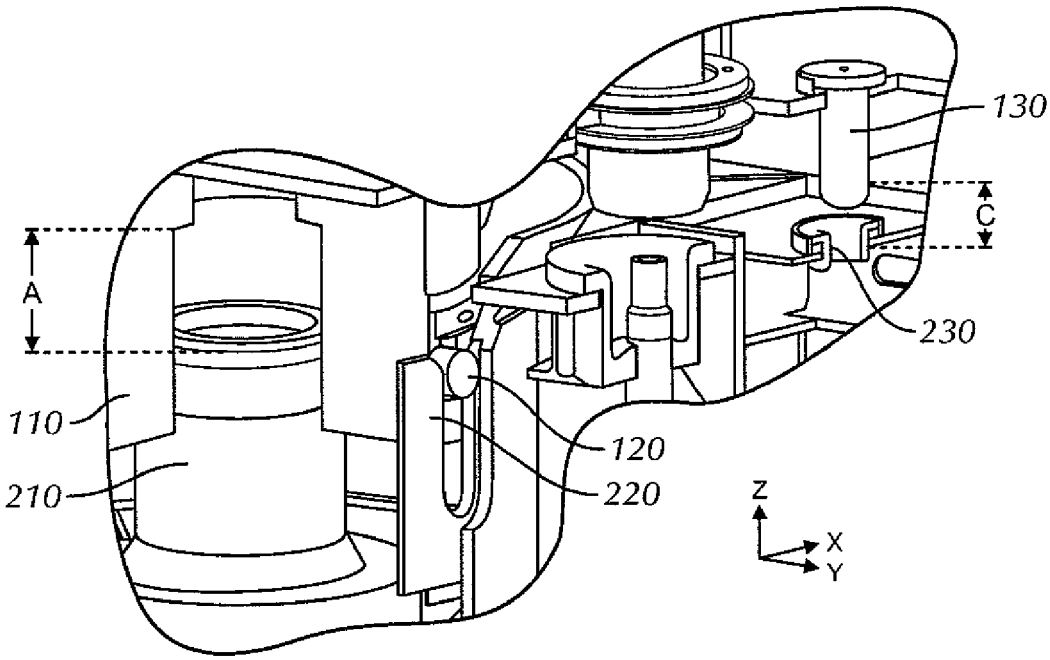
FIG. 3 is an assembly view of a ring alignment pin and an alignment plate in accordance with embodiments of the present disclosure.

In some embodiments, as the make-up sequence continues between LMRP assembly 100 and Lower Stack 200, an alignment ring pin 120 of LMRP assembly 100 may engage an alignment plate 220 of Lower Stack 200 as shown in FIG. 3. The engagement between alignment ring pin 120 and alignment plate 220 may pre-align LMRP assembly 100 and Lower Stack 200 rotationally within about a ½ degree (about Z axis). This pre-alignment may allow the next components, which may include a final alignment pin 130 and a final alignment pin receiver 230, to be put into proper position and engage one another further along in the make-up sequence. At this stage, final alignment pin 130 and final alignment pin receiver 230 may have a distance C remaining before engagement. In certain embodiments, distance C may be between about 9.5 and 10.5 inches. Additionally, LMRP connector 110 may have further engaged with mandrel connector 210. The distance A remaining before the LMRP assembly 100 and Lower Stack 200 are fully engaged may be reduced, and may now be between about 14 and 15 inches.

Referring now to FIG. 4A-C, in some embodiments, the make-up sequence may continue as final alignment pin 130 mates with final alignment pin receiver 230. Upon this engagement, LMRP assembly 100 and Lower Stack 200 may be rotationally aligned with each other, and only a small distance D of vertical travel may remain before the last component, which is a floating choke and kill connection 140, 240 engages. In certain embodiments, distance D may be between about 1 and 2 inches. Further, the distance A remaining before LMRP assembly 100 and Lower Stack 200 are fully engaged may be reduced to between about 4 and 5 inches.

FIG. 5 shows an initial engagement of a critical component between LMRP assembly 100 and Lower Stack 200, which is floating choke and kill connection 140, 240. At this point, the vertical distance A remaining before the fully mated condition between LMRP assembly 100 and Lower Stack is reduced to between about 2.5 and 3.5 inches. The initial engagement between a male connector body 140 and a female C/K bucket 240 pre-aligns the component within about 1/16 inch, however, a final alignment between the two is carried out once they are hydraulically engaged, which will be described later. As stated, the connection is a "floating" connection, thus connector body 140 is able to move freely in the XY plane up to about ¾ inch off an axial centerline, and it also may rotate freely about the X and Y axis approximately 1 degree of the vertical Z axis.

At this stage, LMRP connector 110 may "bottom out" on mandrel connector 210 leaving a gap between LMRP 100 and Lower Stack 200 of approximately 2 inches. LMRP connector 110 may then be hydraulically engaged and locked to mandrel connector 210 with a BOP hydraulic system, as will be understood by those skilled in the art. LMRP 100 and Lower Stack 200 are considered to be fully engaged at this stage; however Lower Stack 200 is not fully functional until critical components including MUX pod wedge and receiver 150, 250, and choke and kill connections 140, 240 are hydraulically engaged.

The critical components of the assembly include the MUX pod wedge and receiver combination, and the choke and kill (C/K) feed-thrus. Proper engagement of these critical components is necessary to allow them to provide the proper functionality and allow communication between LMRP assembly 100 and Lower Stack 200, as they are used to control or manipulate various valves in the BOP assembly during operation. Further, proper engagement between the critical components is important so as to prevent damage to the critical components during engagement, which could lead to costly repairs and downtime.

Figure 6A:
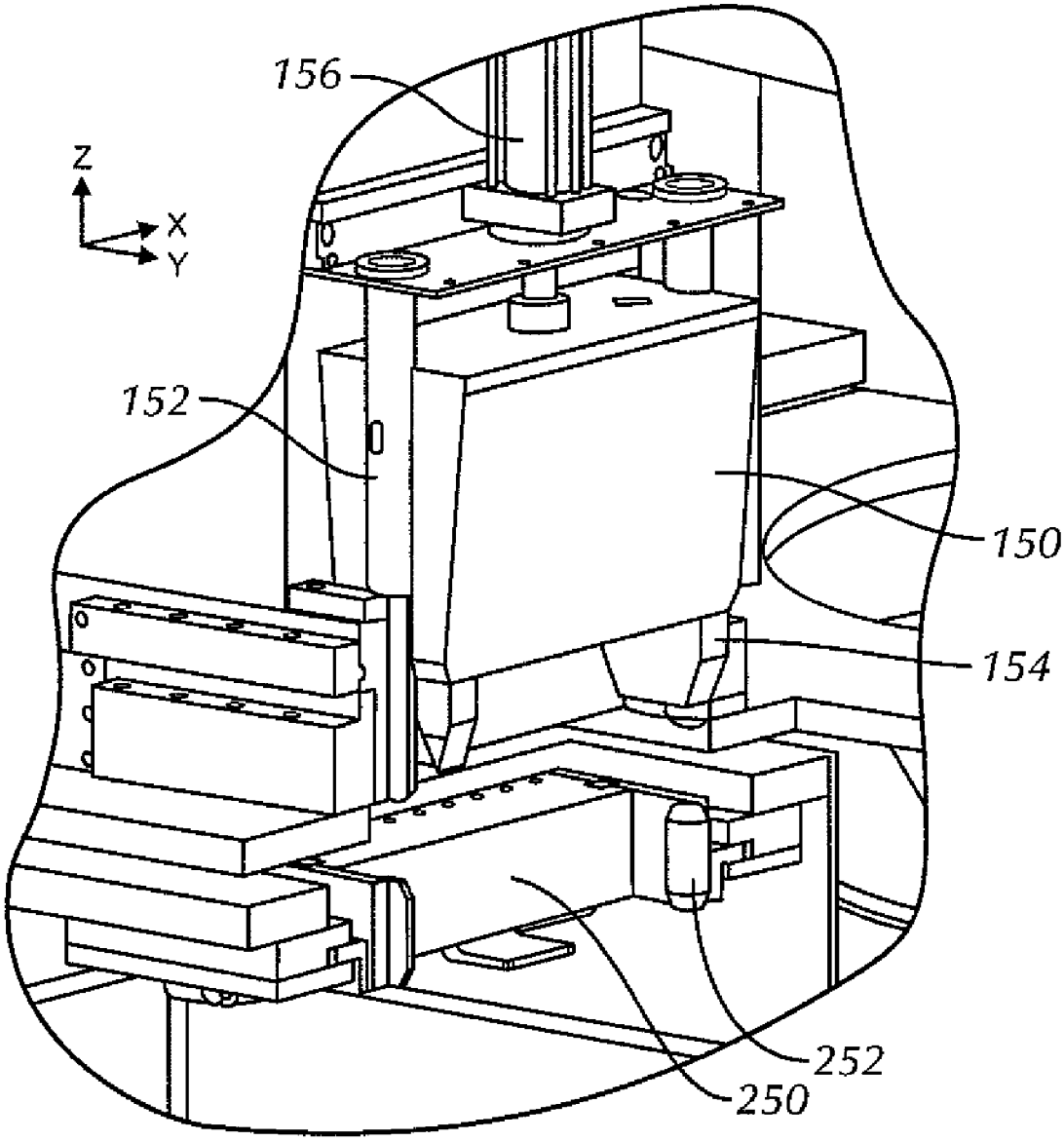
FIGS. 6A-6C are assembly views of a MUX pod wedge and receiver combination in accordance with embodiments of the present disclosure.
Figure 6B:
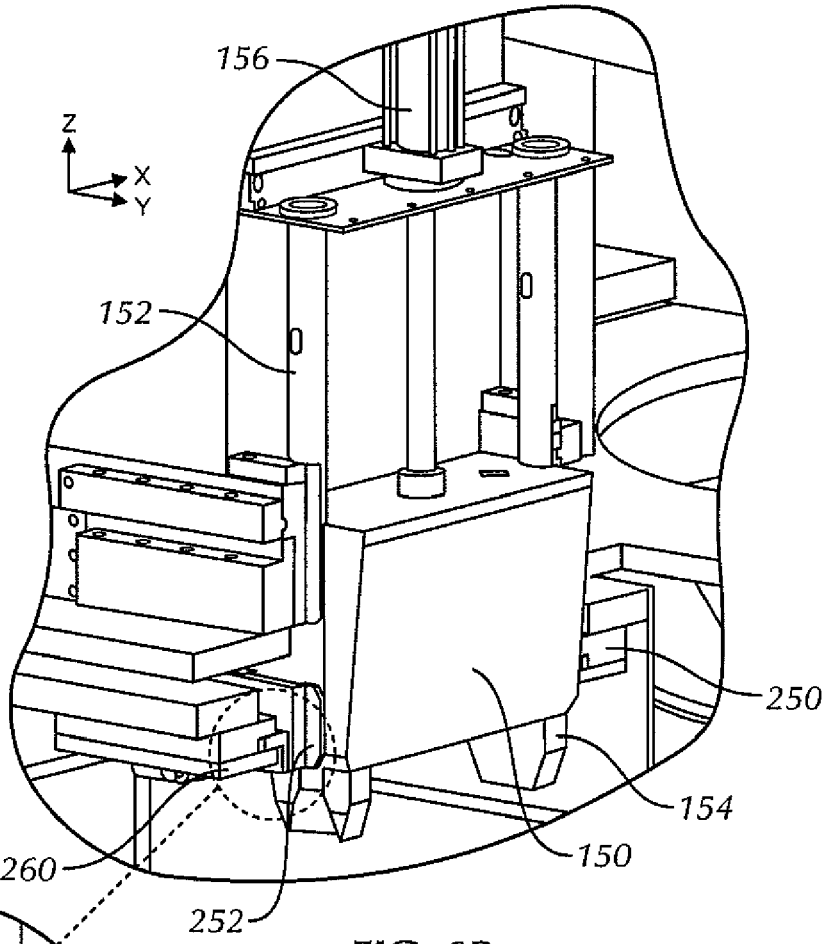
Figure 6C:
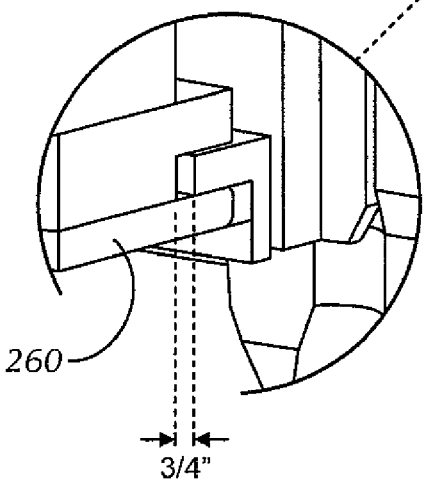

FIGS. 6A-C show a MUX pod wedge 150 and floating receiver 250 in both retracted (FIG. 6A) and extended (FIG. 6B) positions in accordance with embodiments of the present disclosure. A hydraulic cylinder 156 pushes wedge 150 downward along guide rails 152. As wedge 150 travels downward, extensions 154 mounted on a bottom face contact alignment pins 252 mounted on receiver 250 causing the floating receiver 250 to align itself with wedge 150. In certain embodiments, floating receiver 250 rests on a support plate 254 with no fasteners, allowing it to float. As shown in FIG. 6C, receiver 250 may move freely in any direction on the XY plane, up to about ¾ inch off centerline, which allows for angular misalignment between wedge 150 and receiver 250.

Figure 7A:
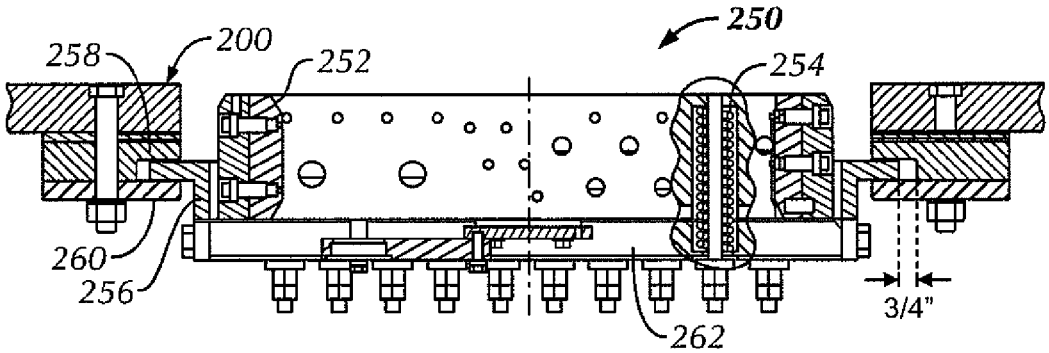
FIGS. 7A and 7B are detailed views of a MUX pod receiver in accordance with embodiments of the present disclosure.
Figure 7B:
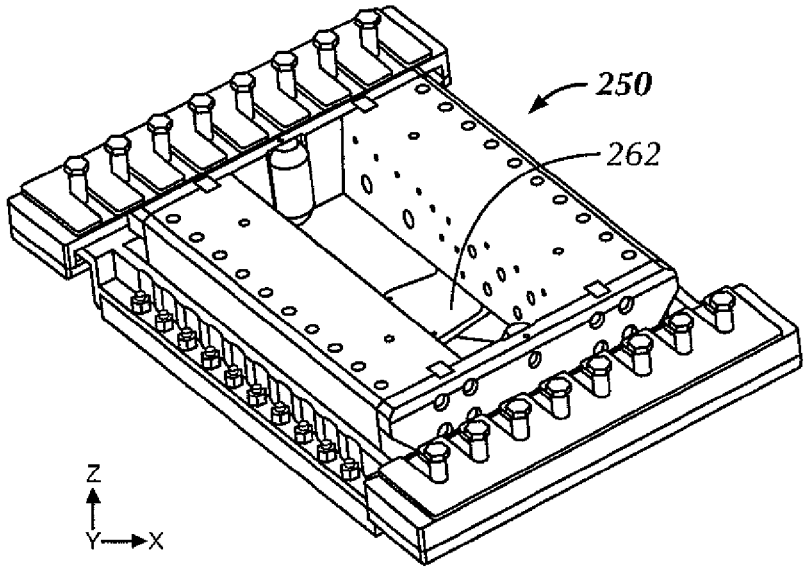

Referring to FIG. 7A, a detailed section view of floating receiver 250 is shown in accordance with embodiments of the present disclosure. Receiver 250 "floats" on a set of springs 254 that are fastened to a spring frame 256. Spring frame 256 is held in place between a support block 258 and a support plate 260 which are fastened together, and is free to move in any direction in the XY plane up to ¾ inch off centerline as previously mentioned. Further, receiver 250 may have about ¾ inch downward vertical travel (−Z direction) and may rotate about the X or Y axis to compensate for any angular misalignment between itself and wedge 150. FIG. 7B shows a perspective view of floating receiver 250 in accordance with embodiments of the present disclosure. In addition, there may be a receiver plate 262 attached to the bottom of receiver 250, which is configured to accept an additional guide pin (not shown) which is fixed to the center of wedge 150. When wedge 150 is lowered into place, the guide pin makes contact with an opening in receiver plate 262, thus causing receiver 250 to align itself with wedge 150.

Figure 8A:
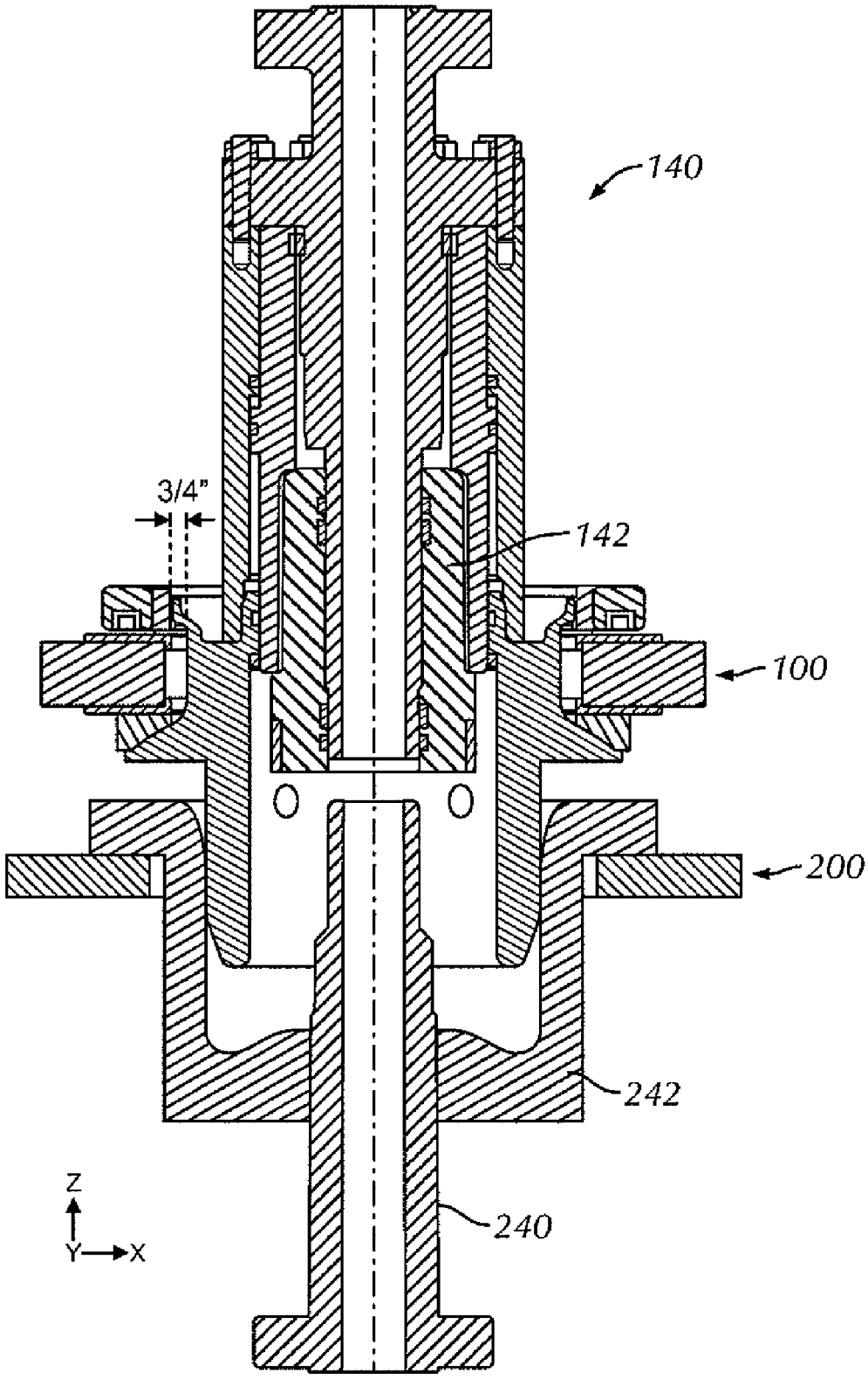
FIGS. 8A and 8B are section views of a choke and kill connection before and after hydraulic engagement in accordance with embodiments of the present disclosure.
Figure 8B:
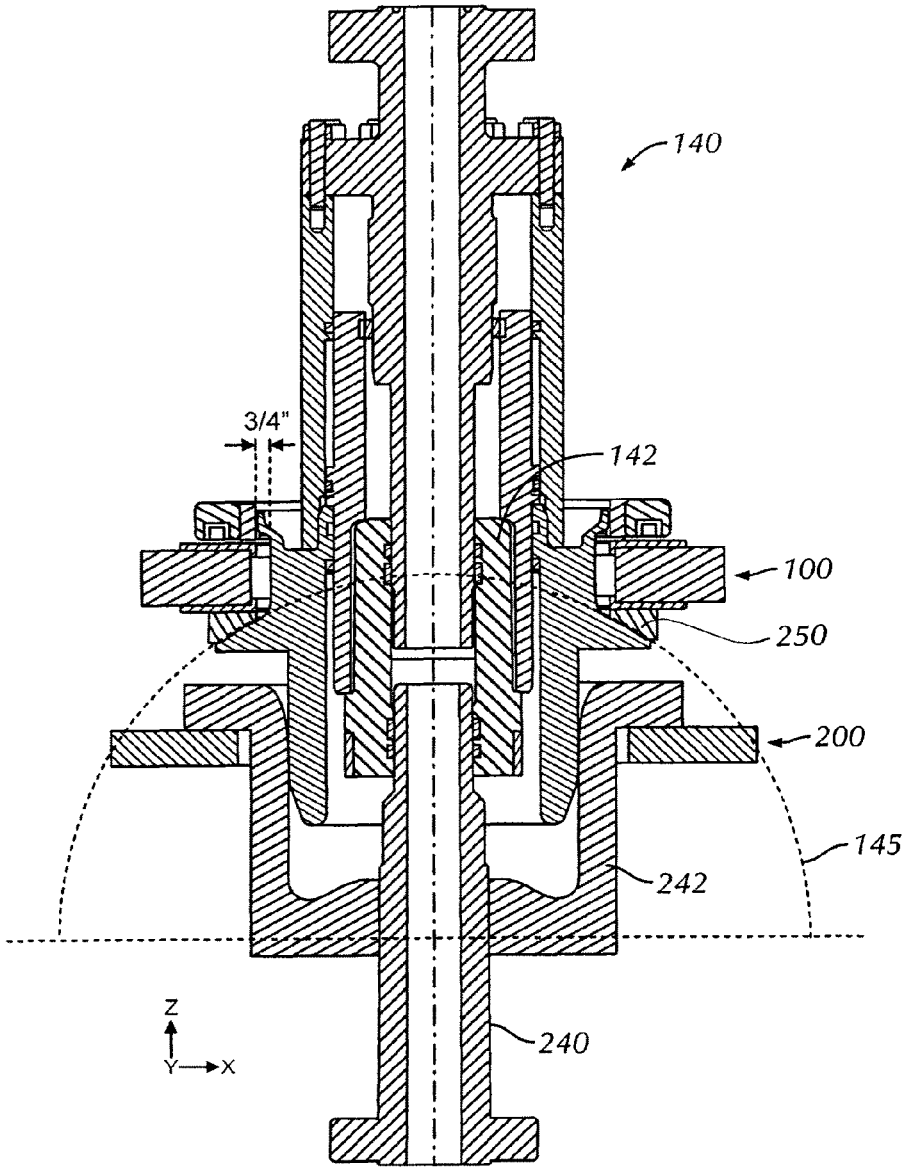
Figure 9:
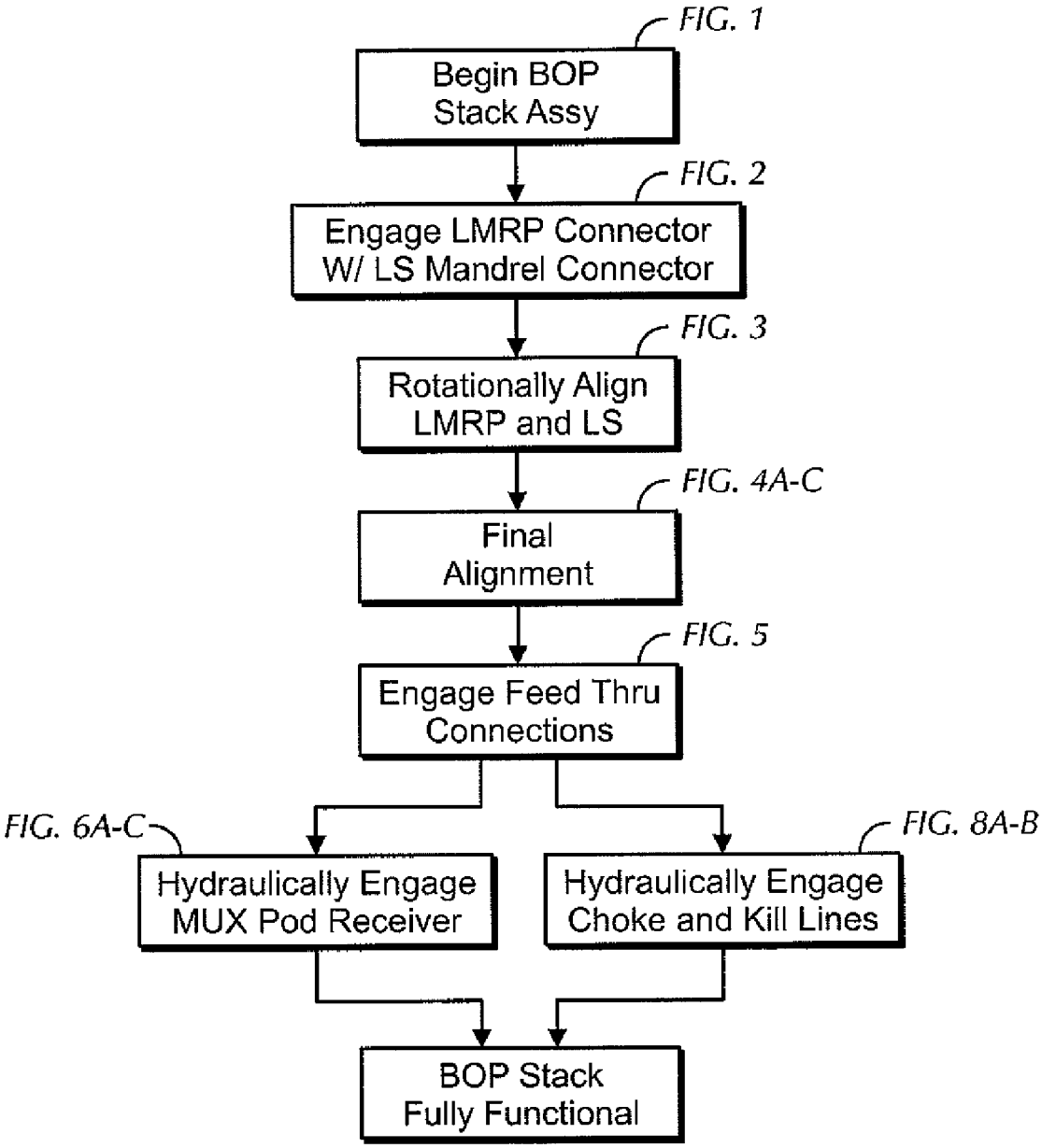
FIG. 9 is a flowchart showing an assembly process of a BOP stack in accordance with embodiments of the present disclosure.

Referring to FIG. 8, section views of choke and kill (C/K) connector 140, 240 are shown in retracted (FIG. 8A) and extended (FIG. 8B) positions in accordance with embodiments of the present disclosure. Initially, female C/K connector 140 is aligned in C/K bucket 242, after which piston 142 of female C/K connector 140 is extended and aligns over male C/K connector 240 (shown in FIG. 8B). Female C/K connector 140 is mounted to the LMRP frame 100 with a spring loaded spherical thrust bearing system 250. Female connector 140 may be free to move in any direction in the XY plane up to about ¾ inch off centerline. The spherical bearing 250 may also allow connector 140 to rotate about the X and Y axis approximately 1 degree off the vertical Z axis as shown by rotation path 145.

As previously mentioned, after fully engaging MUX pod wedge and receiver 150, 250, and C/K connector 140, 240, LMRP 100 and Lower Stack 200 are in communication with each other and may be considered fully functional. In the event that they should be separated, the critical components may first be disengaged and prepared for separation, followed by separation of LMRP 100 and Lower Stack 200. Further, if the need arises, either LMRP 100 or Lower Stack 200 may be removed and replaced with another interchangeable LMRP 100 or Lower Stack 200, of which the assembly will follow the procedure as outlined above.

Advantageously, embodiments of the present disclosure may allow the LMRP and the Lower Stack to be assembled separately without having to first be mated together for adjustments. The elimination of a unique and individual design for each assembly may allow a mass production of the assemblies because of their interchangeability. The ability to mass produce such assemblies may further lead to increased productivity of the assemblies and/or efficiency of manufacturing the assemblies. The increased efficiency of mass producing the interchangeable LMRP and Lower Stack assemblies may lead to decreased production costs. Further, interchangeable LMRP and Lower Stack assemblies may provide fewer occurrences of misfit features, which leads to costly rig downtime and multiple trips to and from the surface when installing the assemblies, While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A method of assembling a subsea pressure control device to be interchangeably attached with plural receiving pressure control devices, the method comprising:

providing a layout including at least one hole on a frame of the movable pressure control device;

forming the hole in the frame such that a size of the formed hole along an axis of the frame is larger than a size of a first half of a feed-thru component by a first predetermined amount, which is larger than normal tolerances;

placing the first half of the feed-thru component in the formed hole of the frame;

positioning the first half inside the formed hole relative to a first datum selected on the frame and a second datum selected as a centerline of the pressure control device;

moving the first half inside the formed hole until a position of the first half relative to the first and second datums is within normal tolerances with regard to one of plural desired positions of the first half relative to the first and second datums; and fixing the first half to the frame.

2. The method of claim 1, further comprising:

providing the layout including the at least one hole on a receiving frame of a receiving pressure control device;

forming a corresponding hole in the receiving frame of the receiving pressure control device such that a size of the formed hole along an axis of the receiving frame is larger than a size of a second half of the feed-thru component by a second predetermined amount, which is larger than normal tolerances;

placing the second half of the feed-thru component in the formed hole of the receiving frame; and floating the second half of the feed-thru component.

3. The method of claim 2, wherein the floating comprises:

freely rotating at least a part of the second half of the feed-thru component about a point of contact between the first half of the feed-thru component and the second half of the feed-thru component.

4. The method of claim 2, wherein the floating comprises:

translating at least a part of the second half of the feed-thru component in a plane bounded by the hole of the receiving frame of the receiving pressure control device.

5. The method of claim 2, further comprising:

providing a bearing ring or a spherical alignment element between the receiving frame of the receiving pressure control device and the second half of the feed-thru component to allow the entire second half of the feed-thru component to rotate relative to the receiving frame.

6. The method of claim 1, further comprising:

providing the layout including the at least one hole on a receiving frame of a receiving pressure control device;

forming a corresponding hole in the receiving frame of the receiving pressure control device such that a size of the formed hole along an axis of the receiving frame is larger than a size of a second half of the feed-thru component by a second predetermined amount, which is larger than normal tolerances;

placing the second half of the feed-thru component in the formed hole of the receiving frame;

positioning the second half inside the formed hole of the receiving frame relative to a third datum selected on the receiving frame until a position of the second half relative to the third datum is within normal tolerances with regard to a desired position of the second half relative to the third datum; and fixing the second half to the receiving frame.

7. The method of claim 1, wherein the feed-thru component is at least one of a choke line, a kill line, a wellbore, a hot stab line, a multiplex hydraulic line, a hydraulic line, an electrical line, or a blowout preventer operating line.

8. The method of claim 1, wherein the pressure control device is a lower marine riser package and the plural receiving pressure control devices are lower blowout preventer stacks, which are deployed undersea.

9. A subsea pressure control device configured to be interchangeable with plural receiving pressure control devices, the subsea pressure control device comprising:

a frame on which at least an oversized hole is formed, the oversized hole being larger than a layout hole that is designed to accommodate a first half of a feed-thru component; and the first half of the feed-thru component which is configured to mate with a second half of the feed-thru component, the first half being positioned inside the oversized hole such that a position of the first half relative to a first datum on the frame and a second datum which is a centerline of the subsea pressure control device is within normal tolerances with regard to one of plural desired positions of the first half relative to the first and second datums, wherein a part of the first half is fixed to the frame after being positioned inside the oversized hole.

10. The subsea pressure control device of claim 9, wherein the entire first half is fixed to the frame.

11. The subsea pressure control device of claim 9, wherein the feed-thru component is at least one of a choke line, a kill line, a wellbore, a hot stab line, a multiplex hydraulic line, a hydraulic line, an electrical line, or a blowout preventer operating line.

12. A system including a subsea pressure control device configured to be interchangeable with plural receiving pressure control devices, the system comprising:

a frame of the subsea control device on which at least an oversized hole is formed, the oversized hole being larger than a layout hole that is designed to accommodate a first half of a feed-thru component; and the first half of the feed-thru component which is configured to mate with a second half of the feed-thru component, the first half being positioned inside the oversized hole such that a position of the first half relative to a first datum on the frame and a second datum which is a centerline of the subsea pressure control device is within normal tolerances with regard to one of plural desired positions of the first half relative to the first and second datums, wherein a part of the first half is fixed to the frame after being positioned inside the oversized hole.

13. The system of claim 12, further comprising:

a receiving frame of a receiving pressure control device, the receiving frame having an oversized hole corresponding to the oversized hole of the subsea pressure control device and the oversized hole of the receiving frame being configured to accommodate the second half of the feed-thru component; and the second half of the feed-thru component being positioned in the oversized hole of the receiving frame and being configured to float.

14. The system of claim 13, wherein the second half floats by rotating at least a part of the second half of the feed-thru component about a point of contact between the first half of the feed-thru component and the second half of the feed-thru component.

15. The system of claim 13, wherein the second half floats by translating at least a part of the second half of the feed-thru component in a plane bounded by the oversized hole of the receiving frame of the receiving pressure control device.

16. The system of claim 12, further comprising:

a bearing ring or a spherical alignment element provided between the receiving frame of the receiving pressure control device and the second half of the feed-thru component to allow the entire second half of the feed-thru component to rotate relative to the receiving frame.

17. The system of claim 12, wherein the feed-thru component is one of a choke line or kill line.

18. The system of claim 17, further comprising:

another feed-thru component that is a multiplex hydraulic line, a first half of the another feed-thru component being a wedge block and a second half of the another feed-thru component being a wedge receiver;

the wedge block being configured to perform a linear motion relative to the wedge receiver, and the wedge receiver being configured to rotate and translate when contacted by the wedge block.

* * * * *